US009046283B2

(12) United States Patent
Morimoto et al.

(10) Patent No.: US 9,046,283 B2
(45) Date of Patent: Jun. 2, 2015

(54) AIR-CONDITIONING APPARATUS

(75) Inventors: Hiroyuki Morimoto, Chiyoda-ku (JP); Koji Yamashita, Chiyoda-ku (JP); Yuji Motomura, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 136 days.

(21) Appl. No.: 13/577,747

(22) PCT Filed: Feb. 10, 2010

(86) PCT No.: PCT/JP2010/000819

§ 371 (c)(1),
(2), (4) Date: Aug. 8, 2012

(87) PCT Pub. No.: WO2011/099059

PCT Pub. Date: Aug. 18, 2011

(65) Prior Publication Data

US 2012/0304681 A1 Dec. 6, 2012

(51) Int. Cl.
*F25B 13/00* (2006.01)
*F25B 25/00* (2006.01)

(52) U.S. Cl.
CPC ..... *F25B 13/00* (2013.01); *F25B 25/005* (2013.01); *F25B 2313/02743* (2013.01); *F25B 2313/006* (2013.01); *F25B 2313/0231* (2013.01)

(58) Field of Classification Search
CPC ..... F25B 41/04; F25B 41/043; F25B 41/046; F25B 2313/000231; F24F 2221/54; Y02B 30/72
USPC ..... 62/324.6, 217, 222
See application file for complete search history.

(56) References Cited

U.S. PATENT DOCUMENTS 2,893,218 A * 7/1959 Harnish ..... 62/180
2,907,178 A * 10/1959 McNatt ..... 62/95

(Continued)

FOREIGN PATENT DOCUMENTS

EP 2284456 A1 * 2/2011
JP 2-085579 A 3/1990

(Continued)

OTHER PUBLICATIONS

English translation of EP2284456A1.*

(Continued)

*Primary Examiner* — Cheryl J Tyler
*Assistant Examiner* — Melanie Phero
(74) *Attorney, Agent, or Firm* — Buchanan Ingersoll & Rooney PC

(57) ABSTRACT

An air-conditioning apparatus includes a heat medium circuit that circulates a heat medium different to the refrigerant on a heat source side. The heat medium circuit includes, for example, heat exchangers related to heat medium, use side heat exchangers, first heat medium flow switching devices and second heat medium flow switching devices that change passages of the use side heat exchangers, heat medium flow control devices that controls a heat medium amount in the corresponding use side heat exchangers. An on-off device is each provided on the upstream side of the heat medium flow control device and on the downstream side of the second heat medium flow switching device and a first backflow prevention device is each provided on the downstream side of the heat medium flow control device and on the upstream side of the first heat medium flow switching device.

7 Claims, 8 Drawing Sheets

(56) References Cited

U.S. PATENT DOCUMENTS

| | | | | |
|---|---|---|---|---|
| 4,862,705 | A * | 9/1989 | Nakamura et al. | 62/324.1 |
| 6,952,933 | B2 * | 10/2005 | Song et al. | 62/200 |
| 2006/0254294 | A1 * | 11/2006 | Shimamoto et al. | 62/238.7 |
| 2008/0236185 | A1 * | 10/2008 | Choi et al. | 62/332 |

FOREIGN PATENT DOCUMENTS

| | | | |
|---|---|---|---|
| JP | 4-024477 | A | 1/1992 |
| JP | 5-280818 | A | 10/1993 |
| JP | 6-300379 | A | 10/1994 |
| JP | 7-091711 | A | 4/1995 |
| JP | 2001-289465 | A | 10/2001 |
| JP | 2003-343936 | A | 12/2003 |
| JP | 2005-140444 | A | 6/2005 |
| WO | WO 2009/133644 | A1 | 11/2009 |

OTHER PUBLICATIONS

International Search Report (PCT/ISA/210) issued on Apr. 13, 2010, by the Japanese Patent Office as the International Searching Authority for International Application No. PCT/JP2010/000819.

Office Action issued on Jan. 13, 2014, by the Chinese Patent Office in corresponding Chinese Patent Application No. 201080063509.0, and an English Translation of the Office Action. (8 pages).

The Extended European Search Report issued on Mar. 7, 2014, by the European Patent Office in corresponding European Patent Application No. 10845665.8. (5 pages).

* cited by examiner

AIR-CONDITIONING APPARATUS

TECHNICAL FIELD

The present invention relates to an air-conditioning apparatus that is applied to, for example, a multi-air-conditioning apparatus for a building.

BACKGROUND ART

In conventional air-conditioning apparatuses such as a multi-air-conditioning apparatus for a building, cooling operation or heating operation is carried out by circulating a refrigerant between an outdoor unit that is a heat source device disposed outdoors and indoor units disposed indoors. Specifically, a conditioned space is heated with the air that has been heated by the refrigerant transferring heat to the air and is cooled with the air that has been cooled by the refrigerant removing its heat. Regarding the refrigerant used for such an air-conditioning apparatus, hydrofluorocarbon (HFC) based refrigerant, for example, is typically used. An air-conditioning apparatus using a natural refrigerant, such as carbon dioxide ($CO_2$), has also been proposed.

There is also an air-conditioning apparatus having a different configuration represented by a chiller system. Further, in such an air-conditioning apparatus, cooling or heating is carried out such that cooling energy or heating energy is generated in a heat source device disposed outdoors; a heat medium such as water or brine is heated or cooled in a heat exchanger disposed in an outdoor unit; and the heat medium is conveyed to indoor units, such as a fan coil unit, a panel heater, or the like, disposed in the conditioned space (for example, see Patent Literature 1).

Moreover, there is an air-conditioning apparatus called a heat recovery chiller that connects a heat source unit to each indoor unit with four water pipings arranged therebetween, supplies cooled and heated water or the like simultaneously, and allows the cooling and heating in the indoor units to be selected freely (for example. see Patent Literature 2).

In addition, there is an air-conditioning apparatus that disposes a heat exchanger for a primary refrigerant and for a secondary refrigerant near each indoor unit in which the secondary refrigerant is conveyed to the indoor unit (see Patent Literature 3, for example).

Furthermore, there is an air-conditioning apparatus that connects an outdoor unit to each branch unit including a heat exchanger with two pipings in which a secondary refrigerant is carried to the corresponding indoor unit (see Patent Literature 4, for example).

CITATION LIST

Patent Literature

Patent Literature 1: Japanese Unexamined Patent Application Publication No. 2005-140444 (p. 4, FIG. 1, for example)

Patent Literature 2: Japanese Unexamined Patent Application Publication No. 5-280818 (pp. 4 and 5, FIG. 1, for example)

Patent Literature 3: Japanese Unexamined Patent Application Publication No. 2001-289465 (pp. 5 to 8, FIG. 1, FIG. 2, for example)

Patent Literature 4: Japanese Unexamined Patent Application Publication No. 2003-343936 (p. 5, FIG. 1)

SUMMARY OF INVENTION

Technical Problem

In an air-conditioning apparatus of the related art, such as a multi-air-conditioning apparatus for a building, a refrigerant may leak into, for example, an indoor space since the refrigerant is circulated to an indoor unit. On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat medium needs to be heated or cooled in a heat source unit disposed outside a structure, and needs to be carried to the indoor unit side. Accordingly, a circulation path of the heat medium becomes long. In this case, when conveying heat for a predetermined heating or cooling work with the heat medium, energy consumption due to conveyance power and the like becomes higher than the energy consumed by the refrigerant. As the circulation path becomes longer, therefore, the conveyance power becomes markedly large. This indicates that energy saving can be achieved in an air-conditioning apparatus if the circulation of the heat medium can be controlled appropriately.

In the air-conditioning apparatus disclosed in Patent Literature 2, the four pipings connecting the outdoor side and the indoor space need to be arranged in order to allow cooling or heating to be selected in each indoor unit. Disadvantageously, there is little ease of construction. In the air-conditioning apparatus disclosed in Patent Literature 3, secondary medium circulating means such as a pump needs to be provided to each indoor unit. Disadvantageously, the system is not only costly but also creates a large noise, and is not practical. In addition, since the heat exchanger is disposed near each indoor unit, the risk of refrigerant leakage to a place near the indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units are connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipings. Accordingly, there is little ease of construction in such a system.

Additionally, in the air-conditioning apparatuses disclosed in Patent Literature 1 and Patent Literature 2 in which a plurality of indoor units (use side heat exchangers) are connected to a single secondary side circuit (the circuit on the side in which the use side heat exchangers are connected), when a heat medium flow control device (on-off valve, flow control valve, or the like) that controls the amount of heat medium flowing in an use side heat exchanger malfunctions, for example, maintenance of the particular indoor unit cannot be performed without disadvantageously suspending the operation of all of the indoor units.

The invention has been made to overcome at least one of the above problems, and an object thereof is to obtain an air-conditioning apparatus that can improve safety by not circulating a refrigerant in an indoor unit or to a vicinity of the indoor unit. Further, another object is to obtain an air-conditioning apparatus that is capable of improving maintainability.

Solution to Problem

An air-conditioning apparatus according to the invention includes a refrigerant circuit that is a circuit through which a heat source side refrigerant flows, the refrigerant circuit connecting a compressor, a heat source side heat source side heat exchanger, a plurality of expansion devices, and a plurality of heat exchangers related to heat medium that exchange heat between the heat source side refrigerant and a heat medium different to the heat source side refrigerant; and a heat medium circuit that is a circuit through which the heat medium is made to circulate, the heat medium circuit connecting the plurality of heat exchangers related to heat medium, a plurality of pumps, a plurality of use side heat exchangers, a plurality of first heat medium flow switching devices that allow an outlet side passage of each of the use side heat exchangers to be in communication with the heat exchangers related to heat medium selectively, a plurality of second heat medium flow switching devices that allow the inlet side passage of each of the use side heat exchangers to be in communication with the heat exchangers related to heat medium selectively, and a plurality of heat medium flow control devices that control a flow rate of the heat medium flowing in the use side heat exchangers, in which the air-conditioning apparatus is capable of performing a cooling and heating mixed operation mode, a first on-off device that opens and closes the heat medium circuit is provided to a portion of the heat medium circuit that is on an upstream side of each heat medium flow control device and on a downstream side of the corresponding second heat medium flow switching device, a backflow prevention device that is capable of restricting the flow of the heat medium from each first heat medium flow switching devices to the corresponding heat medium flow control device is provided to a portion of the heat medium circuit that is on the downstream side of the heat medium flow control device and on the upstream side of the first heat medium flow switching device.

Advantageous Effects of Invention

The air-conditioning apparatus of the invention circulates a heat medium in the indoor unit for heating or cooling air of the conditioned space and does not circulate any refrigerant in the indoor unit. Thus, even if the refrigerant were to leak into the conditioned space, for example, penetration of the refrigerant into the indoor space can be restrained, and a safe air-conditioning apparatus can be obtained. Further, by providing first on-off devices and backflow prevention devices, it will be possible to perform maintenance to a particular indoor unit during the operation of the air-conditioning apparatus without suspending all of the indoor units.

DESCRIPTION OF EMBODIMENTS

Embodiment 1

Figure 1:
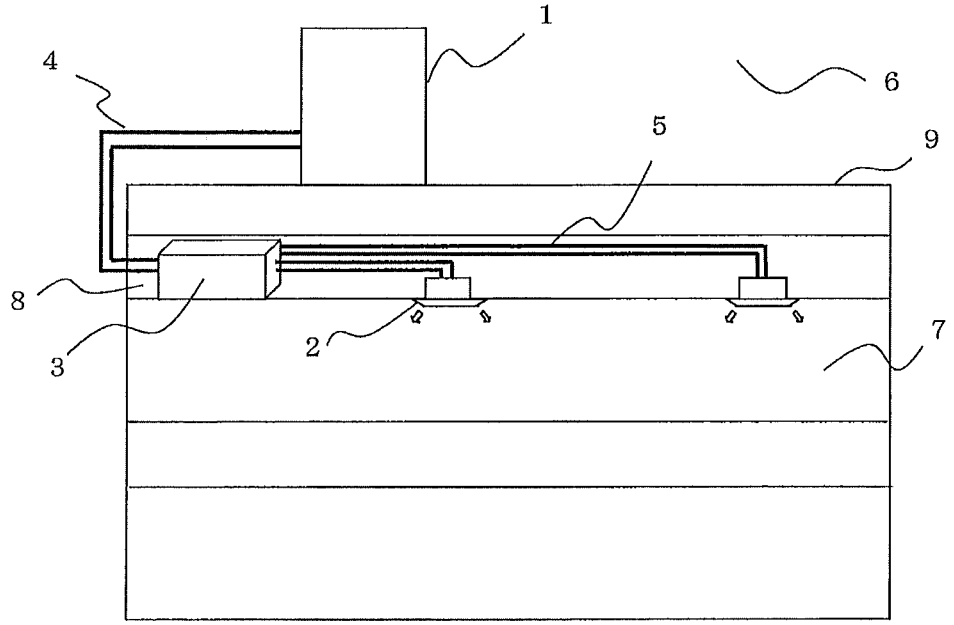
FIG. 1 is a schematic diagram illustrating an exemplary installation of an air-conditioning apparatus according to Embodiment 1 of the invention.

Embodiment 1 of the invention will be described with reference to the accompanying drawings. FIG. 1 is a schematic diagram illustrating an exemplary installation of an air-conditioning apparatus according to Embodiment 1 of the invention. The exemplary installation of the air-conditioning apparatus will be described with reference to FIG. 1. This air-conditioning apparatus uses refrigeration cycles (a refrigerant circuit A and a heat medium circuit B) in which refrigerants (a heat source side refrigerant and a heat medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment 1 includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between a heat source side refrigerant and a heat medium that is different to this heat source side refrigerant. The outdoor unit 1 and the heat medium relay unit 3 are connected with refrigerant pipings 4 thorough which the heat source side refrigerant flows. The heat medium relay unit 3 and each indoor unit 2 are connected with pipings 5 (heat medium pipings) through which the heat medium flows. Cooling energy or heating energy generated in the outdoor unit 1 is delivered through the heat medium relay unit 3 to the indoor units 2.

The outdoor unit 1 is typically disposed in an outdoor space 6 which is a space (e.g., a roof) outside a structure 9, such as a building, and is configured to supply cooling energy or heating energy through the heat medium relay unit 3 to the indoor units 2. Each indoor unit 2 is disposed at a position that can supply cooling air or heating air to an indoor space 7, which is a space (e.g., a living room) inside the structure 9, and supplies air for cooling and air for heating to the indoor space 7 that is a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipings 4 and is connected to the indoor units 2 through the pipings 5 to convey cooling energy or heating energy supplied from the outdoor unit 1 to the indoor units 2.

As illustrated in FIG. 1, in the air-conditioning apparatus according to Embodiment 1, the outdoor unit 1 is connected to the heat medium relay unit 3 using two refrigerant pipings 4, and the heat medium relay unit 3 is connected to each indoor unit 2 using two pipings 5. As described above, in the air-conditioning apparatus according to Embodiment 1, since each of the units (the outdoor unit 1, the indoor units 2, and the heat medium relay unit 3) is connected using two pipings (the refrigerant pipings 4 or the pipings 5), construction is facilitated. Further, by providing the heat medium relay unit 3 close to the indoor units 2, the piping of the circuit in which the heat medium circulates (the heat medium circuit B) can be shortened. Accordingly, the conveyance power of the heat medium can be reduced and energy saving can be achieved.

Furthermore, FIG. 1 illustrates a state where the heat medium relay unit 3 is disposed in the structure 9 but in a space different from the indoor space 7, for example, a space above a ceiling (hereinafter, simply referred to as a "space 8"). The heat medium relay unit 3 can be disposed in other spaces, such as a common space where an elevator or the like is installed. In addition, although FIG. 1 illustrates a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIG. 1 illustrates a case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the heat medium relay unit 3 can be disposed near the outdoor unit 1. It should be noted that when the distance from the heat medium relay unit 3 to the indoor unit 2 is excessively long, because power for conveying the heat medium is significantly large, the advantageous effect of energy saving is reduced. Additionally, the numbers of connected outdoor unit 1, indoor units 2, and heat medium relay units 3 are not limited to those illustrated in FIG. 1. The numbers thereof can be determined in accordance with the structure 9 where the air-conditioning apparatus according to Embodiment 1 is installed.

Figure 2:
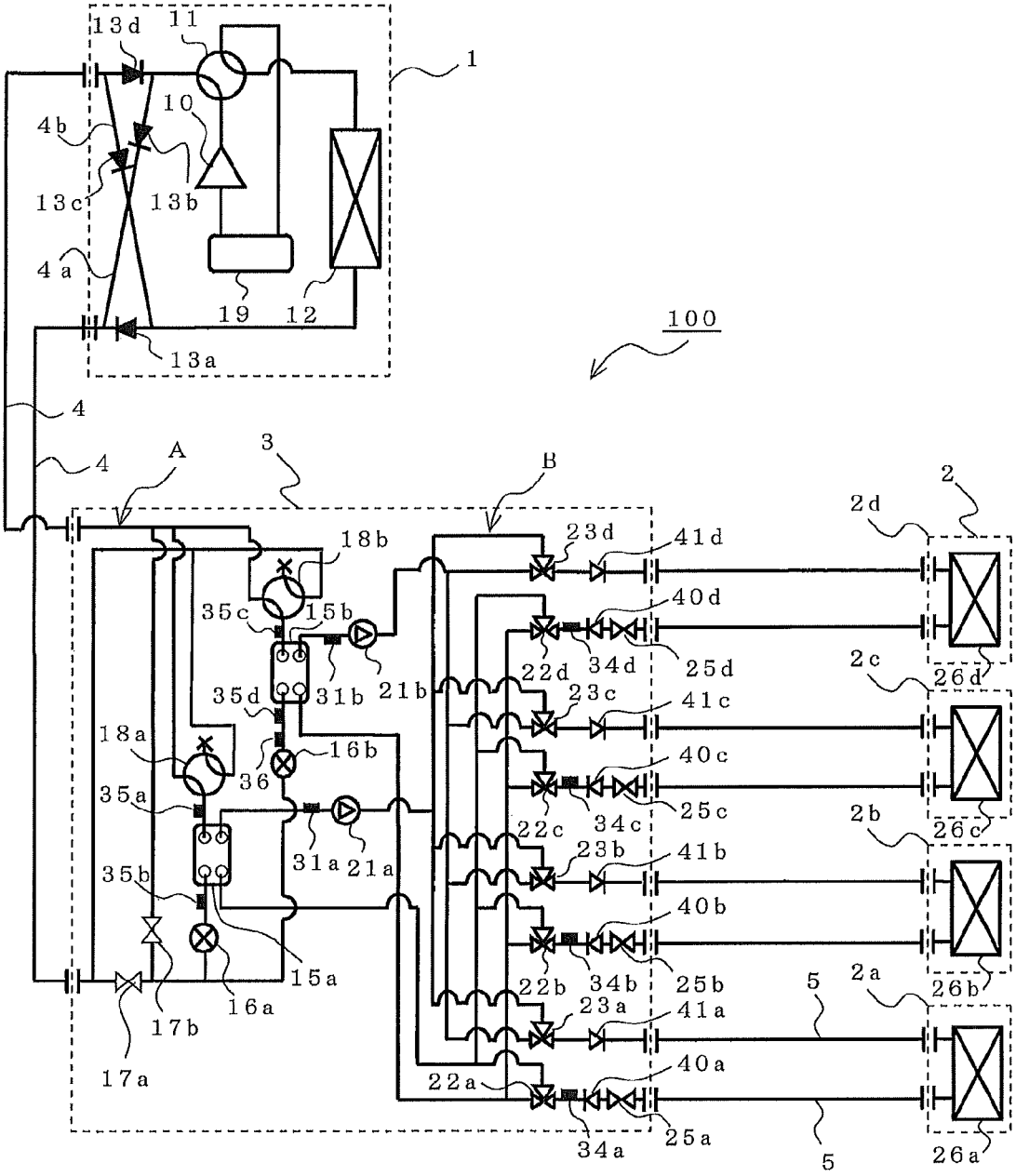
FIG. 2 is a schematic circuit diagram illustrating an exemplary circuit configuration of an air-conditioning apparatus according to Embodiment 1 of the invention.

FIG. 2 is a schematic circuit diagram illustrating an exemplary circuit configuration of the air-conditioning apparatus (hereinafter, referred to as an "air-conditioning apparatus 100") according to Embodiment 1 of the invention. The detailed configuration of the air-conditioning apparatus 100 will be described with reference to FIG. 2. As illustrated in FIG. 2, the outdoor unit 1 and the heat medium relay unit 3 are connected with the refrigerant pipings 4 through heat exchangers related to heat medium 15*a* and 15*b* included in the heat medium relay unit 3. Furthermore, the heat medium relay unit 3 and the indoor units 2 are connected with the pipings 5 through the heat exchangers related to heat medium 15*a* and 15*b*. Note that the refrigerant piping 4 will be described in detail later.

Outdoor Unit 1

The outdoor unit 1 includes a compressor 10, a first refrigerant flow switching device 11, such as a four-way valve, a heat source side heat exchanger 12, and an accumulator 19, which are connected in series with the refrigerant pipings 4. The outdoor unit 1 further includes a first connecting piping 4*a*, a second connecting piping 4*b*, a check valve 13*a*, a check valve 13*b*, a check valve 13*c*, and a check valve 13*d*. By providing the first connecting piping 4*a*, the second connecting piping 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by the indoor units 2.

The compressor 10 sucks in the heat source side refrigerant and compress the heat source side refrigerant to a high-temperature high-pressure state. The compressor 10 may include, for example, a capacity-controllable inverter compressor. The first refrigerant flow switching device 11 switches the flow of the heat source side refrigerant between a heating operation (heating only operation mode and heating main operation mode) and a cooling operation (cooling only operation mode and cooling main operation mode). The heat source side heat exchanger 12 functions as an evaporator in the heating operation, functions as a condenser (or a radiator) in the cooling operation, exchanges heat between air supplied from the air-moving device, such as a fan (not illustrated), and the heat source side refrigerant, and evaporates and gasifies or condenses and liquefies the heat source side refrigerant. The accumulator 19 is provided on the suction side of the compressor 10 and retains excess refrigerant.

The check valve 13*d* is provided in the refrigerant piping 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant piping 4 between the heat source side heat exchanger 12 and the heat medium relay unit 3 and permits the heat source side refrigerant to flow only in a predetermined direction (the direction from the outdoor unit 1 to the heat medium relay unit 3). The check valve 13*b* is provided in the first connecting piping 4*a* and allows the heat source side refrigerant discharged from the compressor 10 to flow through the heat medium relay unit 3 during the heating operation. The check valve 13*c* is disposed in the second connecting piping 4*b* and allows the heat source side refrigerant, returning from the heat medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat medium relay unit 3, in the outdoor unit 1. The second connecting piping 4*b* is configured to connect the refrigerant piping 4, between the check valve 13*d* and the heat medium relay unit 3, to the refrigerant piping 4, between the heat source side heat exchanger 12 and the check valve 13*a*, in the outdoor unit 1. It should be noted that FIG. 2 illustrates a case in which the first connecting piping 4*a*, the second connecting piping 4*b*, the check valve 13*a*, the check valve 13*b*, the check valve 13*c*, and the check valve 13*d* are disposed, but the device is not limited to this case, and they do not necessarily have to be provided.

Indoor Units 2

The indoor units 2 each include a use side heat exchanger 26. The use side heat exchanger 26 is each connected to a heat medium flow control device 25 and a second heat medium flow switching device 23 in the heat medium relay unit 3 with the pipings 5. Each of the use side heat exchangers 26 exchanges heat between air supplied from an air-moving device, such as a fan, (not illustrated) and the heat medium in order to generate air for heating or air for cooling supplied to the indoor space 7.

FIG. 2 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIG. 1, the number of connected indoor units 2 illustrated in FIG. 2 is not limited to four.

Heat Medium Relay Unit 3

The heat medium relay unit 3 includes the two heat exchangers related to heat medium 15, two expansion devices 16, two on-off devices 17, two second refrigerant flow switching devices 18, two pumps 21, four first heat medium flow switching devices 22, the four second heat medium flow switching devices 23, the four heat medium flow control devices 25, and four first heat medium backflow prevention devices 40 and second heat medium backflow prevention devices 41.

Each of the two heat exchangers related to heat medium 15 (the heat exchanger related to heat medium 15*a* and the heat exchanger related to heat medium 15*b*) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to heat the heat medium in the cooling and heating mixed operation mode. Additionally, the heat exchanger related to heat medium 15*b* is disposed between an expansion device 16*b* and a second refrigerant flow switching device 18*b* in the refrigerant circuit A and is used to cool the heat medium in the cooling and heating mixed operation mode.

The two expansion devices 16 (the expansion device 16*a* and the expansion device 16*b*) each have functions of a reducing valve and an expansion valve and are configured to reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, such as an electronic expansion valve.

The two on-off devices 17 (an on-off device 17*a* and an on-off device 17*b*) each include, for example, a two-way valve and open and close the refrigerant piping 4. The on-off device 17*a* is disposed in the refrigerant piping 4 on the inlet side of the heat source side refrigerant. The on-off device 17*b* is disposed in a piping connecting the refrigerant piping 4 on the inlet side of the heat source side refrigerant and the refrigerant piping 4 on an outlet side thereof. The two second refrigerant flow switching devices 18 (the second refrigerant flow switching devices 18*a* and 18*b*) each include, for example, a four-way valve and switch passages of the heat source side refrigerant in accordance with the operation mode. The second refrigerant flow switching device 18*a* is disposed downstream of the heat exchanger related to heat medium 15*a*, downstream regarding the heat source side refrigerant flow during the cooling operation. The second refrigerant flow switching device 18*b* is disposed downstream of the heat exchanger related to heat medium 15*b*, downstream regarding the heat source side refrigerant flow during the cooling only operation.

The two pumps 21 (a pump 21*a* and a pump 21*b*) circulate the heat medium through the piping 5. The pump 21*a* is disposed in the piping 5 between the heat exchanger related to heat medium 15*a* and the second heat medium flow switching devices 23. The pump 21*b* is disposed in the piping 5 between the heat exchanger related to heat medium 15*b* and the second heat medium flow switching devices 23. Each of the two pumps 21 may include, for example, a capacity-controllable pump.

The four first heat medium flow switching devices 22 (first heat medium flow switching devices 22*a* to 22*d*) each include, for example, a three-way valve and switches passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding heat medium flow control device 25. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) each include, for example, a three-way valve and are configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding use side heat exchanger 26. Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

The four heat medium flow control devices 25 (heat medium flow control devices 25*a* to 25*d*) each include, for example, a two-way valve capable of controlling the area of opening and controls the flow rate of the flow in each use side heat exchanger 26 (piping 5). The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22 through the first backflow prevention device 40. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

The four first backflow prevention devices 40 (first backflow prevention devices 40*a* to 40*d*) each include a check valve and is disposed between the corresponding first heat medium flow switching device 22 and heat medium flow control device 25. Each first backflow prevention device 40 permits the heat medium to flow from the heat medium flow control device 25 towards the first heat medium flow switching device 22. That is, each first backflow prevention device 40 restricts the heat medium from flowing from the first heat medium flow switching device 22 towards the heat medium flow control device 25. Furthermore, illustrated from the bottom of the drawing are the first backflow prevention device 40*a*, the first backflow prevention device 40*b*, the first backflow prevention device 40*c*, and the first backflow prevention device 40*d* so as to correspond to the respective indoor units 2.

The four second backflow prevention devices 41 (second backflow prevention devices 41*a* to 41*d*) each include a check valve and is disposed between the corresponding second heat medium flow switching device 23 and use side heat exchanger 26 (indoor unit 2). Each second backflow prevention device 41 permits the heat medium to flow from the second heat medium flow switching device 23 towards the use side heat exchanger 26. That is, each second backflow prevention device 41 restricts the heat medium from flowing from the use side heat exchanger 26 towards the second heat medium flow switching device 23. Furthermore, illustrated from the bottom of the drawing are the second backflow prevention device 41*a*, the second backflow prevention device 41*b*, the second backflow prevention device 41*c*, and the second backflow prevention device 41*d* so as to correspond to the respective indoor units 2.

The heat medium relay unit 3 includes various detecting devices (two first temperature sensors 31, four second temperature sensors 34, four third temperature sensors 35, and a pressure sensor 36). Information (temperature information and pressure information) detected by these detecting devices are transmitted to a controller (not illustrated) that performs integrated control of the operation of the air-conditioning apparatus 100 such that the information is used to control, for example, the driving frequency of the compressor 10, the rotation speed of the air-moving device (not illustrated), switching of the first refrigerant flow switching device 11, the driving frequency of the pumps 21, switching of the second refrigerant flow switching devices 18, and switching of passages of the heat medium.

Each of the two first temperature sensors 31 (a first temperature sensor 31*a* and a first temperature sensor 31*b*) detects the temperature of the heat medium flowing out of the corresponding heat exchanger related to heat medium 15, namely, the heat medium at an outlet of the corresponding heat exchanger related to heat medium 15 and may include, for example, a thermistor. The first temperature sensor 31*a* is disposed in the piping 5 on the inlet side of the pump 21*a*. The first temperature sensor 31*b* is disposed in the piping 5 on the inlet side of the pump 21*b*.

Each of the four second temperature sensors 34 (second temperature sensors 34*a* to 34*d*) is disposed between the corresponding first heat medium flow switching device 22 and heat medium flow control device 25 and detects the temperature of the heat medium flowing out of each use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of the heat source side refrigerant of the corresponding heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Further, the controller (not illustrated) includes, for example, a microcomputer and controls, for example, the driving frequency of the compressor 10, the rotation speed (including ON/OFF) of the air-moving device, switching of the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow direction switching devices 23, and the opening degree of each heat medium flow control device 25 on the basis of the information detected by the various detecting devices and an instruction from a remote control to carry out the operation modes which will be described later. Note that the controller may be provided to each unit, or may be provided to the outdoor unit 1 or the heat medium relay unit 3.

The pipings 5 in which the heat medium flows include the pipings connected to the heat exchanger related to heat medium 15*a* and the pipings connected to the heat exchanger related to heat medium 15*b*. Each piping 5 is branched (into four in this case) in accordance with the number of indoor units 2 connected to the heat medium relay unit 3. The pipings 5 are connected by the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26. That is, by controlling the first heat medium flow switching device 22 and the second heat medium flow switching device 23, each of the passage on the inflow side and the outflow side of the use side heat exchanger 26 can be selectively allowed to be in communication with the heat exchanger related to heat medium 15*a* or the heat exchanger related to heat medium 15*b*.

In the air-conditioning apparatus 100, the compressor 10, the first refrigerant flow switching device 11, the heat source side heat exchanger 12, the on-off devices 17, the second refrigerant flow switching devices 18, a refrigerant passage of the heat exchanger related to heat medium 15*a*, the expansion devices 16, and the accumulator 19 are connected through the refrigerant piping 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected through the pipings 5, thus forming the heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

Various operation modes executed by the air-conditioning apparatus 100 will be described below. The air-conditioning apparatus 100 allows each indoor unit 2, on the basis of an instruction from the indoor unit 2, to perform a cooling operation or heating operation. Specifically, the air-conditioning apparatus 100 allows all of the indoor units 2 to perform the same operation and also allows each of the indoor units 2 to perform different operations.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. The operation modes will be described below with respect to the flow of the heat source side refrigerant and that of the heat medium.

Cooling Only Operation Mode

Figure 3:
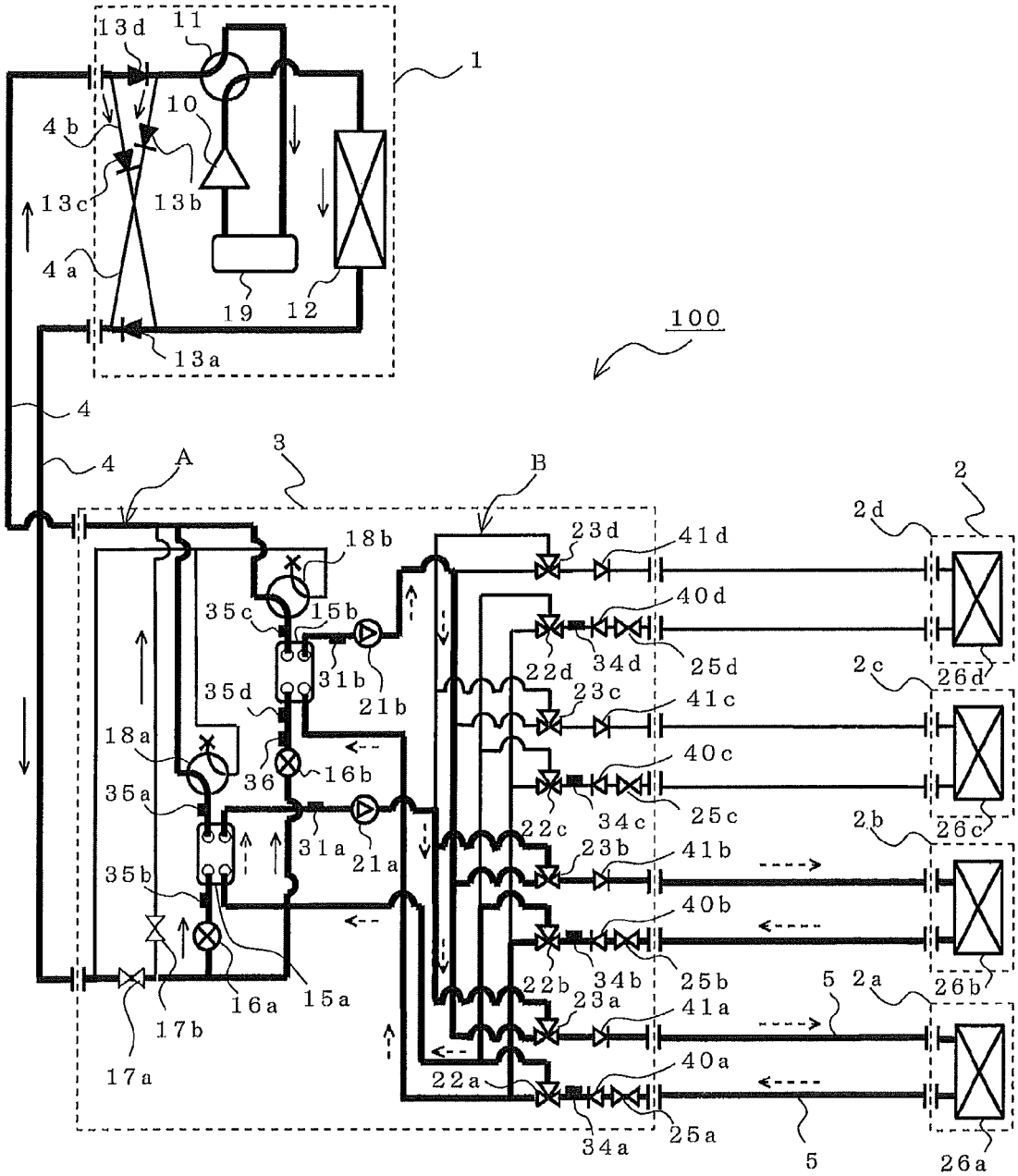
FIG. 3 is a refrigerant circuit diagram illustrating flows of refrigerants in a cooling only operation mode of the air-conditioning apparatus according to Embodiment 1 of the invention.

FIG. 3 is a refrigerant circuit diagram illustrating the flows of the refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 3. Furthermore, in FIG. 3, pipings indicated by thick lines indicate pipings through which the heat source side refrigerant and the heat medium flow. In addition, the direction of flow of the heat source side refrigerant is indicated by solid-line arrows and the direction of flow of the heat medium is indicated by broken-line arrows in FIG. 3.

In the cooling only operation mode illustrated in FIG. 3, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant piping 4, and flows into the heat medium relay unit 3. The high-pressure liquid refrigerant that has flowed into the heat medium relay unit 3 is branched after passing through the on-off device 17*a* and is expanded into a low-temperature low-pressure two-phase refrigerant by the expansion device 16*a* and the expansion device 16*b*.

This two-phase refrigerant flows into each of the heat exchanger related to heat medium 15*a* and the heat exchanger related to heat medium 15*b*, functioning as evaporators, removes heat from the heat medium circulating in the heat medium circuit B, cools the heat medium, and turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding one of a second refrigerant flow switching device 18*a* and a second refrigerant flow switching device 18*b*, passes through the refrigerant piping 4, and again flows into the outdoor unit 1. The refrigerant; that has flowed into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, in which the superheat is obtained as the difference between a temperature detected by a third temperature sensor 35*c* and that detected by a third temperature sensor 35*d*. In addition, the on-off device 17*a* is opened and the on-off device 17*b* is closed.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipings 5. A portion of the heat medium, which has flowed out of each of the pump 21*a* and the pump 21*b* while being pressurized, flows through the second heat medium flow switching device 23*a* and the second backflow prevention device 41*a* into the use side heat exchanger 26*a*. The remaining portion of the heat medium, which has flowed out of each of the pump 21*a* and the pump 21*b* while being pressurized, flows through the second heat medium flow switching device 23*b* and the second backflow prevention device 41*b* into the use side heat exchanger 26*b*. The heat medium removes heat from the indoor air in each of the use side heat exchanger 26*a* and the use side heat exchanger 26*b*, thus cools the indoor space 7.

Then, the heat medium flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium that has flowed out of the heat medium flow control device 25*a* passes through the first backflow prevention device 40*a* and the first heat medium flow switching device 22*a* and flows into the heat exchanger related to heat medium 15*a* and the heat exchanger related to heat medium 15*b*. The heat medium that has flowed out of the heat medium flow control device 25*b* passes through the first backflow prevention device 40*b* and the first heat medium flow switching device 22*b* and flows into the heat exchanger related to heat medium 15*a* and the heat exchanger related to heat medium 15*b*. The refrigerant that has flowed into the heat exchanger related to heat medium 15*a* and the heat exchanger related to heat medium 15*b* is respectively sucked into the pump 21*a* and the pump 21*b* again.

Note that in the pipings 5 of each use side heat exchanger 26, the heat medium is directed to flow from the second heat medium flow switching device 23 through the second backflow prevention device 41, the heat medium flow control device 25, and the first backflow prevention device 40 to the first heat medium flow switching device 22. The air conditioning load required in the indoor space 7 can be covered by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 3, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Heating Only Operation Mode

Figure 4:
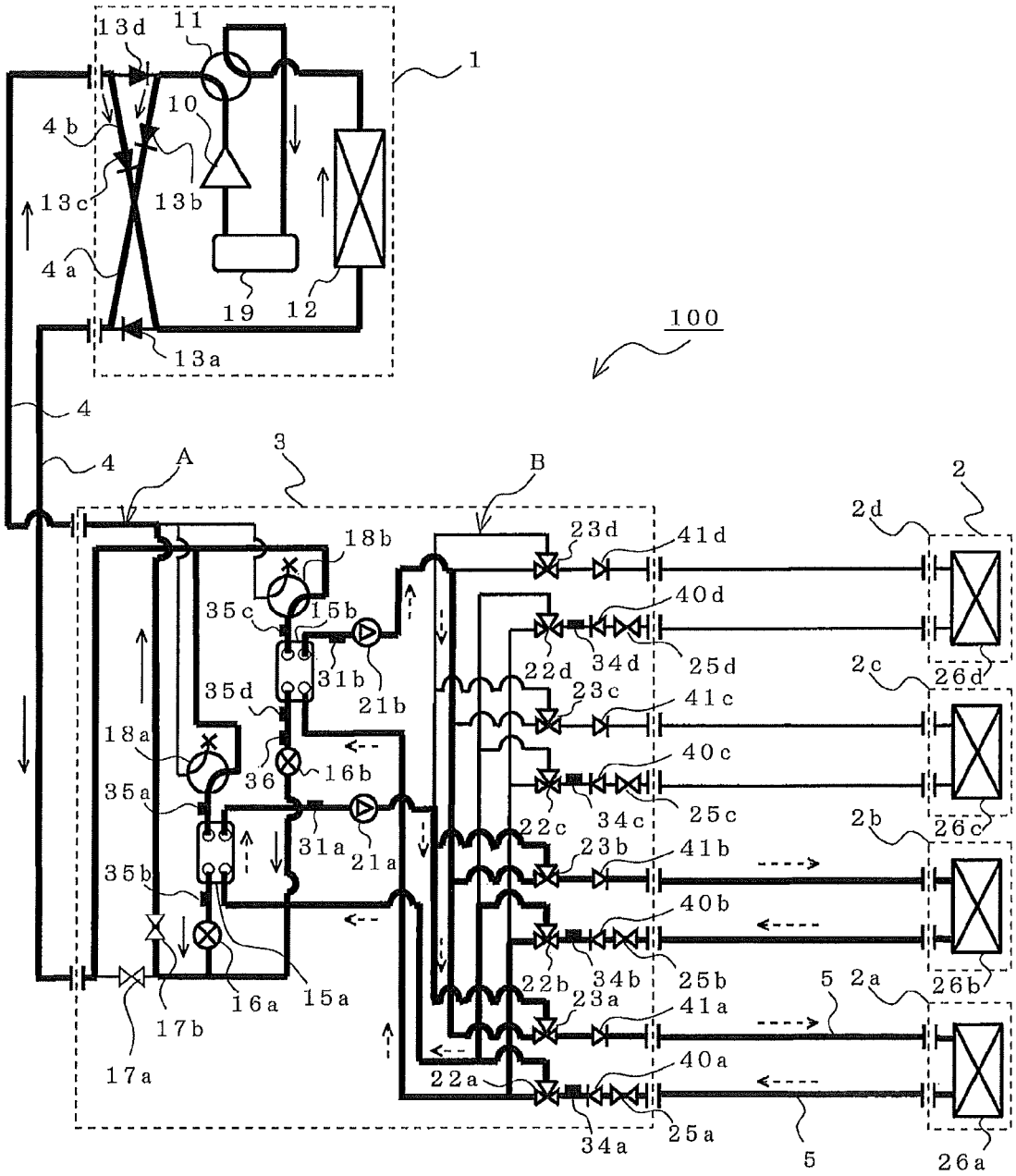
FIG. 4 is a refrigerant circuit diagram illustrating flows of refrigerants in a heating only operation mode of the air-conditioning apparatus according to Embodiment 1 of the invention.

FIG. 4 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 4. Furthermore, in FIG. 4, pipings indicated by thick lines indicate pipings through which the heat source side refrigerant and the heat medium flow. In addition, the direction of flow of the heat source side refrigerant is indicated by solid-line arrows and the direction of flow of the heat medium is indicated by broken-line arrows in FIG. 4.

In the heating only operation mode illustrated in FIG. 4, the first refrigerant flow switching device 11 is switched such that the heat source side refrigerant discharged from the compressor 10 flows into the heat medium relay unit 3 without passing through the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant that has flowed into the heat medium relay unit 3 is branched, passes through each of the second refrigerant flow switching device 18*a* and the second refrigerant flow switching device 18*b*, and flows into the corresponding one of the heat exchanger related to heat medium 15*a* and the heat exchanger related to heat medium 15*b*.

The high-temperature high-pressure gas refrigerant that has flowed into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and that flowing out of the heat exchanger related to heat medium 15*b* are expanded into a low-temperature low-pressure, two-phase refrigerant in the expansion device 16*a* and the expansion device 16*b*. This two-phase refrigerant passes through the on-off device 17*b*, flows out of the heat medium relay unit 3, passes through the refrigerant piping 4, and again flows into the outdoor unit 1. The refrigerant that has flowed into the outdoor unit 1 flows through the second connecting piping 4*b*, passes through the check valve 13*c*, and flows into the heat source side heat exchanger 12 functioning as an evaporator.

Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, in which the subcooling is obtained as the difference between the value indicating the saturation temperature converted from the pressure detected by the pressure sensor 36 and a temperature detected by the third temperature sensor 35*d*. In addition, the on-off device 17*a* is closed and the on-off device 17*b* is opened. Note that when a temperature at the middle position of the heat exchangers related to heat medium 15 can be measured, the temperature at the middle position may be used instead of the pressure sensor 36. Accordingly, the system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipings 5. A portion of the heat medium, which has flowed out of each of the pump 21*a* and the pump 21*b* while being pressurized, flows through the second heat medium flow switching device 23*a* and the second backflow prevention device 41*a* into the use side heat exchanger 26*a*. The remaining portion of the heat medium, which has flowed out of each of the pump 21*a* and the pump 21*b* while being pressurized, flows through the second heat medium flow switching device 23*b* and the second backflow prevention device 41*b* into the use side heat exchanger 26*b*. Then the heat medium transfers heat to the indoor air in the use side heat exchanger 26*a* and the use side heat exchanger 26*b*, thus heats the indoor space 7.

Then, the heat medium flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium that has flowed out of the heat medium flow control device 25*a* passes through the first backflow prevention device 40*a* and the first heat medium flow switching device 22*a* and flows into the heat exchanger related to heat medium 15*a* and the heat exchanger related to heat medium 15*b*. The heat medium that has flowed out of the heat medium flow control device 25*b* passes through the first backflow prevention device 40*b* and the first heat medium flow switching device 22*b* and flows into the heat exchanger related to heat medium 15*a* and the heat exchanger related to heat medium 15*b*. The refrigerant that has flowed into the heat exchanger related to heat medium 15*a* and the heat exchanger related to heat medium 15*b* is respectively sucked into the pump 21*a* and the pump 21*b* again.

Note that in the pipings 5 of each use side heat exchanger 26, the heat medium is directed to flow from the second heat medium flow switching device 23 through the second backflow prevention device 41, the heat medium flow control device 25, and the first backflow prevention device 40 to the first heat medium flow switching device 22. The air conditioning load required in the indoor space 7 can be covered by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. Although the use side heat exchanger 26 should essentially be controlled on the basis of the difference between a temperature at its inlet and that at its outlet, since the temperature of the heat medium on the inlet side of the use side heat exchanger 26 is substantially the same as that detected by the first temperature sensor 31*b*, the use of the first temperature sensor 31 can reduce the number of temperature sensors, so that the system can be constructed inexpensively.

Figure 5:
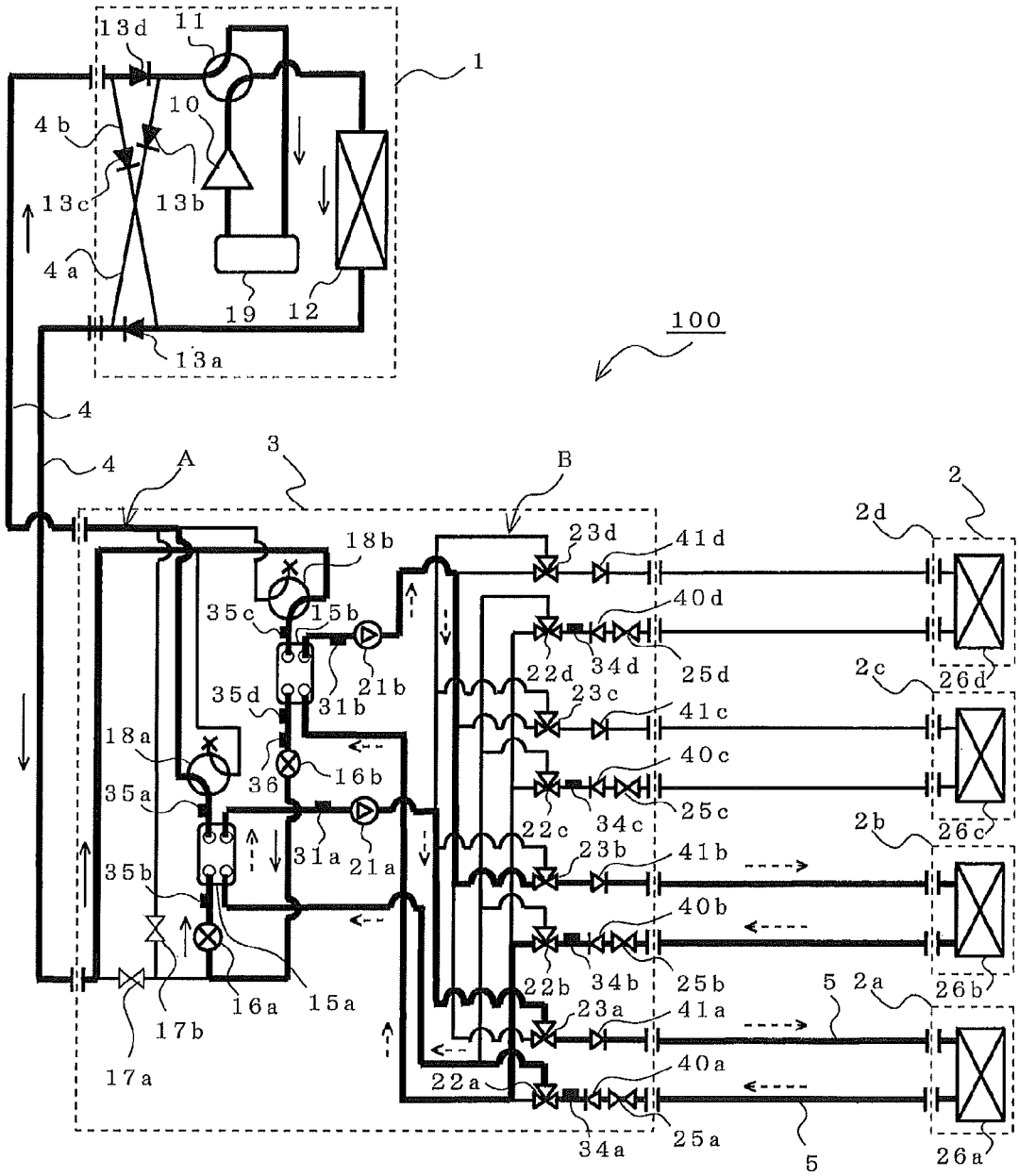
FIG. 5 is a refrigerant circuit diagram illustrating flows of refrigerants in a cooling main operation mode of the air-conditioning apparatus according to Embodiment 1 of the invention.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Cooling Main Operation Mode

FIG. 5 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 5. Furthermore, in FIG. 5, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 5.

In the cooling main operation mode illustrated in FIG. 5, the first refrigerant flow switching device 11 is switched such that the heat source side refrigerant discharged from the compressor 10 flows into the heat source side heat exchanger 12 in the outdoor unit 1. In the heat medium relay unit 3, the pumps 21*a* and 21*b* are driven, the heat medium flow control devices 25*a* and 25*b* are opened, and the heat medium flow control devices 25*c* and 25*d* are totally closed. Further, heat medium circulates between the heat exchanger related to heat medium 15*a* and the use side heat exchanger 26*a*, and between the heat exchanger related to heat medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant piping 4, and flows into the heat medium relay unit 3. The two-phase refrigerant flowing into the heat medium relay unit 3 passes through the second refrigerant flow switching device 18*b* and flows into the heat exchanger related to heat medium 15*b*, functioning as a condenser.

The two-phase refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, cools the heat medium, and turns into a low-pressure gas refrigerant. The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant piping 4. The refrigerant that has flowed into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. Note that the opening degree of the expansion device 16*b* may be controlled such that subcooling is constant, in which the subcooling is obtained as the difference between a value indicating a saturation temperature converted from a pressure detected by the pressure sensor 36 and a temperature detected by the third temperature sensor 35*d*. Alternatively, the expansion device 16*b* may be fully opened and the expansion device 16*a* may control the superheat or the subcooling.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipings 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of the pump 21*b* while being pressurized, flows through the second heat medium flow switching device 23*b* and the second backflow prevention device 41*b* into the use side heat exchanger 26*b*. The heat medium, which has flowed out of the pump 21*a* while being pressurized, flows through the second heat medium flow switching device 23*a* and the second backflow prevention device 41*a* into the use side heat exchanger 26*a*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease in temperature, passes through the heat medium flow control device 25*b*, the first backflow prevention device 40*b*, and the first heat medium flow switching device 22*b*, flows into the heat exchanger related to heat medium 15*b*, and is sucked into the pump 21*b* again. The heat medium, which has passed through the use side heat exchanger 26*a* with a slight increase in temperature, passes through the heat medium flow control device 25*a*, the first backflow prevention device 40*a*, and the first heat medium flow switching device 22*a*, flows into the heat exchanger related to heat medium 15*a*, and is sucked into the pump 21*a* again.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each use side heat exchanger 26 on both the heating side and cooling side, the heat medium is directed to flow from the second heat medium flow switching device 23, the second backflow prevention device 41 through the heat medium flow control device 25, and the first backflow prevention device 40 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Heating Main Operation Mode

Figure 6:
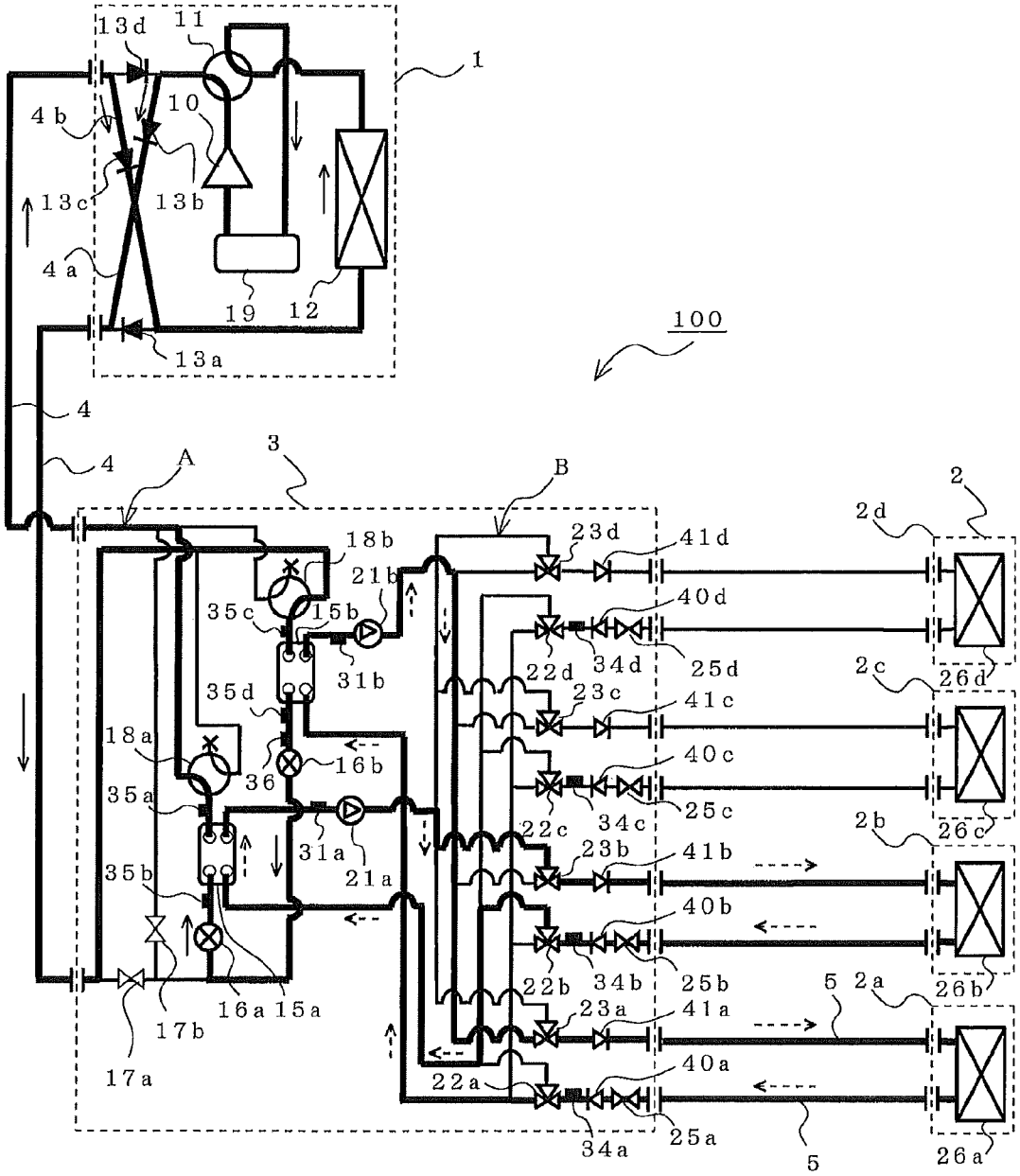
FIG. 6 is a refrigerant circuit diagram illustrating flows of refrigerants in a heating main operation mode of the air-conditioning apparatus according to Embodiment 1 of the invention.

FIG. 6 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 6. Furthermore, in FIG. 6, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 6.

In the heating main operation mode illustrated in FIG. 6, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pumps 21*a* and 21*b* are driven, the heat medium flow control devices 25*a* and 25*b* are opened, and the heat medium flow control devices 25*c* and 25*d* are totally closed. Further, heat medium circulates between the heat exchanger related to heat medium 15*b* and the use side heat exchanger 26*a*, and between the heat exchanger related to heat medium 15*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant that has been discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant that has flowed into the heat medium relay unit 3 passes through the second refrigerant flow switching device 18*b* and flows into the heat exchanger related to heat medium 15*b* functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, is evaporated, and cools the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant piping 4, and again flows into the outdoor unit 1.

The refrigerant that has flowed into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the pipings 5. Furthermore, in the heating main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of the pump 21*b* while being pressurized, flows through the second heat medium flow switching device 23*a* and the second backflow prevention device 41*a* into the use side heat exchanger 26*a*. The heat medium, which has flowed out of the pump 21*a* while being pressurized, flows through the second heat medium flow switching device 23*b* and the second backflow prevention device 41*b* into the use side heat exchanger 26*b*.

In the use side heat exchanger 26*b*, the heat medium removes heat from the indoor air, thus cools the indoor space 7. In addition, in the use side heat exchanger 26*a*, the heat medium transfers heat to the indoor air, thus heats the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase in temperature, passes through the heat medium flow control device 25*b*, the first backflow prevention device 40*b*, and the first heat medium flow switching device 22*b*, flows into the heat exchanger related to heat medium 15*a*, and is sucked into the pump 21*a* again. The heat medium, which has passed through the use side heat exchanger 26*a* with a slight decrease in temperature, passes through the heat medium flow control device 25*a* and the first heat medium flow switching device 22*a*, flows into the heat exchanger related to heat medium 15*b*, and is again sucked into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Refrigerant Piping 4

As described above, the air-conditioning apparatus 100 according to Embodiment 1 has several operation modes. In these operation modes, the heat source side refrigerant flows through the refrigerant pipings 4 connecting the outdoor unit 1 and the heat medium relay unit 3.

Piping 5

In some operation modes carried out by the air-conditioning apparatus 100 according to Embodiment 1, the heat medium, such as water or antifreeze, flows through the pipings 5 connecting the heat medium relay unit 3 and the indoor units 2.

Replacing Method of Heat Medium Flow Control Device

Next, a replacing method of the heat medium flow control device 25 will be described. The heat medium flow control device 25 controls the circulating amount of the heat medium to the use side heat exchanger 26 (including stopping the circulation of the heat medium) and compared to other components, the operating time is long. Accordingly, the heat medium flow control device 25 is a component with a higher possibility of failure compared to other components. However, conventional air-conditioning apparatuses have a problem in which all of the operating indoor units 2 have to be suspended during the replacement of a heat medium flow control device 25.

Accordingly, the air-conditioning apparatus 100 according to Embodiment 1 is added with the below configuration so that a heat medium flow control device 25 connected to a particular indoor unit 2 can be replaced without suspending the operating indoor units 2.

Figure 7:
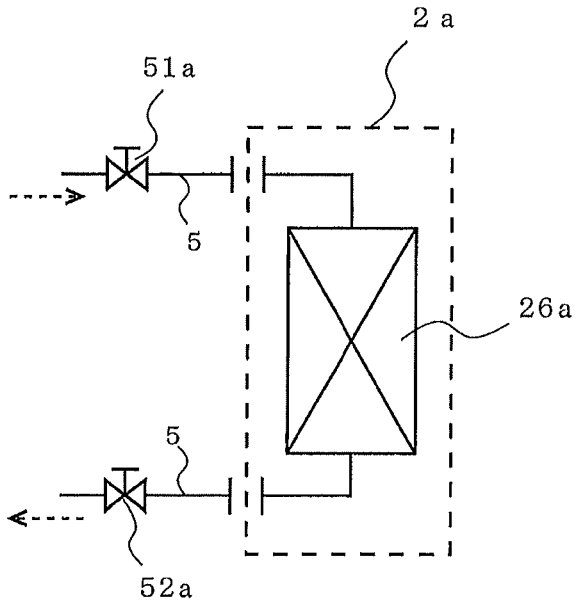
FIG. 7 is an enlarged view of a main section illustrating a vicinity of an indoor unit of an air-conditioning apparatus according to Embodiment 1 of the invention.

Although not illustrated in FIGS. 1 to 6, as shown in FIG. 7, in the air-conditioning apparatus 100 according to Embodiment 1, each inlet and outlet of the indoor units 2 (use side heat exchangers 26) is provided with an on-off device 51 or an on-off device 52. The on-off device 51 is an on-off device that is provided in the piping 5 of each indoor unit 2 on the heat medium inlet side. The on-off device 52 is an on-off device that is provided in the piping 5 of each indoor unit 2 on the heat medium outlet side. In Embodiment 1, a manual on-off valve, for example, is used as the on-off device 51 and the on-off device 52. Note that in FIG. 7, an on-off device 51*a* and an on-off device 52*a* provided to the inlet and outlet of the indoor unit 2*a* is shown. Although not illustrated in FIG. 7, on-off devices 51*b* to 51*d* and on-off devices 52*b* to 52*d* are provided to the inlet and outlet of the indoor units 2*b* to 2*d*, respectively.

Each on-off device 51 and each on-off device 52 are provided to stop the circulation of the heat medium to an indoor unit 2 when replacing the indoor unit 2. Accordingly, the on-off devices 51 and on-off devices 52 are normally in an opened state.

That is, in the air-conditioning apparatus 100 according to Embodiment 1, a heat medium flow control device 25 connected to a particular indoor unit 2 can be replaced without suspending any of the operating indoor units 2 with the on-off device 51, the on-off device 52, and the first backflow prevention device 40.

Either one of the on-off device 51 and the on-off device 52 corresponds to a first on-off device of the invention. Further, the other one of the on-off device 51 and the on-off device 52 corresponds to a third on-off device of the invention. Note that in Embodiment 1, the on-off device 51 and on-off device 52 are provided assuming a case in which an indoor unit 2 is replaced. However, when focusing on the replacement of the heat medium flow control device 25 alone, either one of the on-off device 51 or the on-off device 52 is solely needed to be provided. By providing both the on-off device 51 and the on-off device 52, a particular indoor unit 2 can be replaced without suspending all of the operating indoor units 2, and thus extension of product life of the air-conditioning apparatus 100 can be achieved.

For example, replacing of the heat medium flow control device 25*a* is carried out as below.

When the heat medium flow control device 25*a* is caused to malfunction by some kind of reason, first, a remote control or the like issues an order to the controller and the indoor unit 2*a* is suspended. At this time, the operating states of the indoor units 2*b* to 2*d* do not have to be changed. That is, if the indoor units 2*b* to 2*d* are in operation, they are kept in operation. In other words, the air-conditioning apparatus 100 maintains its operating state.

After suspending the indoor unit 2*a*, the on-off device 52*a* is set to a closed state, for example. Note that instead of the on-off device 52, the on-off device 51*a* can be set to a closed state.

After setting the on-off device 52*a* to a closed state, the heat medium flow control device 25*a* is detached. At this time, the heat medium retained in the piping 5 between the first backflow prevention device 40*a* and the on-off device 52*a* will flow out. However, refrigerant other than that can be prevented from flowing out of the heat medium circuit B. That is, the heat medium circulating in the operating indoor units 2 (indoor units 2*b* to 2*d*, for example) can be prevented from flowing out of the heat medium circuit B. Accordingly, the operation of the operating indoor units 2 can be maintained.

After detaching the heat medium flow control device 25*a*, a new heat medium flow control device 25*a* is mounted to the heat medium relay unit 3 again.

By setting the on-off device 52*a* to an opened state, the indoor unit 2*a* will be in an operational state.

By providing at least either one of the on-off device 51 and the on-off device 52 and by providing a first backflow prevention device 40 that restricts the flow of the heat medium flowing from the first heat medium flow switching device 22 towards the heat medium flow control device 25, when replacing a heat medium flow control device 25 connected to a particular indoor unit 2, the amount of heat medium flowing out from the heat medium circuit B can be suppressed, as well as continuing the operation of the air-conditioning apparatus 100 (operation of each indoor unit 2). Accordingly, an air-conditioning apparatus 100 that has improved maintainability compared to conventional ones can be provided.

In particular, this invention that allows replacement of the heat medium flow control device 25, which has a high possibility of failure than other components, while continuing the operation of the air-conditioning apparatus 100 (operation of each indoor unit 2) is an invention of high benefit.

Note that while in Embodiment 1, a manual on-off valve has been used as each on-off device 51 and 52, it goes without saying that an electronic on-off valve may be used. Embodiment 1 uses a manual on-off device as each on-off device 51 and 52 since it allows no change in the standard control method and allows embodiment of the invention while suppressing the cost of the on-off device.

Embodiment 2

In Embodiment 1, a check valve is used as each first backflow prevention device. However, the invention can be embodied by using an on-off device for each first backflow prevention device. Note that in Embodiment 2, items not described in particular are the same as Embodiment 1 and like functions and configurations are described using like reference numerals.

Figure 8:
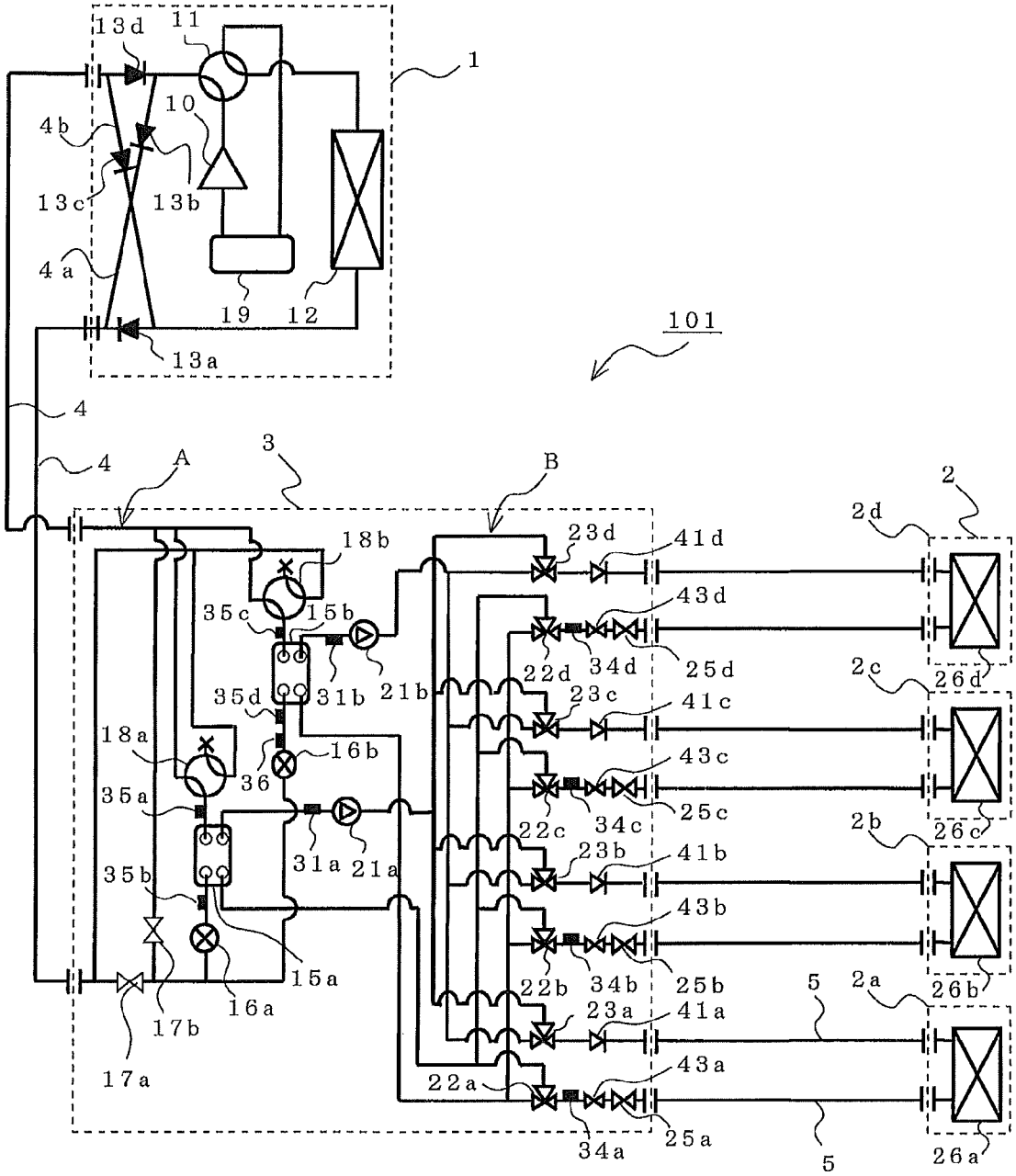
FIG. 8 is a schematic circuit diagram illustrating an exemplary circuit configuration of an air-conditioning apparatus according to Embodiment 2 of the invention.

FIG. 8 is a schematic circuit diagram illustrating an exemplary circuit configuration of the air-conditioning apparatus (hereinafter, referred to as an "air-conditioning apparatus 101") according to Embodiment 2 of the invention.

The basic configuration of the air-conditioning apparatus 101 according to Embodiment 2 is the same as the configuration of the air-conditioning apparatus 100 according to Embodiment 1. Accordingly, although not illustrated in FIG. 8, as shown in FIG. 7, each inlet and outlet of the indoor units 2 (use side heat exchangers 26) is provided with an on-off device 51 or an on-off device 52.

However, the air-conditioning apparatus 101 according to Embodiment 2 is different to the air-conditioning apparatus 100 according to Embodiment 1 in that on-off devices (second on-off devices) that are manual on-off valves are provided as first backflow prevention devices 43. The first backflow prevention devices 43 are in a closed state during normal operation.

Operation (the refrigerant flow in the refrigerant circuit A and the heat medium flow in the heat medium circuit B) of each operation mode that is carried out by the air-conditioning apparatus 101 according to Embodiment 2 is the same as that of the air-conditioning apparatus 100 according to Embodiment 1, and, thus, description will be omitted.

Accordingly, a replacing method of the heat medium flow control device 25 will be subsequently described.

For example, replacing of the heat medium flow control device 25*a* is carried out as below.

When the heat medium flow control device 25*a* is caused to malfunction by some kind of reason, first, a remote control or the like issues an order to the controller and the indoor unit 2*a* is suspended. At this time, the operating states of the indoor units 2*b* to 2*d* do not have to be changed. That is, if the indoor units 2*b* to 2*d* are in operation, they are kept in operation. In other words, the air-conditioning apparatus 101 maintains its operating state.

After suspending the indoor unit 2*a*, the first backflow prevention device 43*a* (on-off device) and, for example, the on-off device 52*a* is set to a closed state. Note that instead of the on-off device 52, the on-off device 51*a* can be set to a closed state.

After setting the first backflow prevention device 43*a* and the on-off device 52*a* to a closed state, the heat medium flow control device 25*a* is detached. At this time, the heat medium retained in the piping 5 between the first backflow prevention device 43*a* and the on-off device 52*a* will flow out. However, refrigerant other than that can be prevented from flowing out of the heat medium circuit B. That is, the heat medium circulating in the operating indoor units 2 (indoor units 2*b* to 2*d*, for example) can be prevented from flowing out of the heat medium circuit B. Accordingly, the operation of the operating indoor units 2 can be maintained.

After detaching the heat medium flow control device 25*a*, a new heat medium flow control device 25*a* is mounted to the heat medium relay unit 3 again.

By setting the first backflow prevention device 43*a* and the on-off device 52*a* to an opened state, the indoor unit 2*a* will be in an operational state.

By providing at least either one of the on-off device 51 and the on-off device 52 and by providing a first backflow prevention device 43 that is a manual on-off valve, when replacing a heat medium flow control device 25 connected to a particular indoor unit 2, the amount of heat medium flowing out from the heat medium circuit B can also be suppressed, as well as continuing the operation of the air-conditioning apparatus 101 (operation of each indoor unit 2). Accordingly, an air-conditioning apparatus 101 that has improved maintainability compared to conventional ones can be provided.

In particular, this invention that allows replacement of the heat medium flow control device 25, which has a high possibility of failure than other components, while continuing the operation of the air-conditioning apparatus 101 (operation of each indoor unit 2) is an invention of high benefit.

Note that while in Embodiment 2, a manual on-off valve has been used as each first backflow prevention device 43, it goes without saying that an electronic on-off valve may be used. Embodiment 2 uses a manual on-off device as each first backflow prevention device 43 since it allows no change in the standard control method and allows embodiment of the invention while suppressing the cost of the on-off device.

REFERENCE SIGNS LIST

1 outdoor unit (heat source unit); 2 indoor unit; 2*a*, 2*b*, 2*c*, 2*d* indoor unit; 3 heat medium relay unit; 4 refrigerant piping; 4*a* first connecting piping; 4*b* second connecting piping; 5 heat medium piping; 6 outdoor space; 7 indoor space; 8 space outside a room such as a space above a ceiling and a space different from the indoor space; 9 structure such as a building; 10 compressor; 11 four-way valve (first refrigerant flow switching device); 12 heat source side heat exchanger; 13*a*, 13*b*, 13*c*, 13*d* check valve; 15*a*, 15*b* heat exchanger related to heat medium; 16*a*, 16*b* expansion device; 17*a*, 17*b* on-off device; 18*a*, 18*b* second refrigerant flow switching device; 19 accumulator; 21*a*, 21*b* pump; 22*a*, 22*b*, 22*c*, 22*d* first heat medium flow switching device; 23*a*, 23*b*, 23*c*, 23*d* second heat medium flow switching device; 25*a*, 25*b*, 25*c*, 25*d* heat medium flow control device; 26*a*, 26*b*, 26*c*, 26*d* use side heat exchanger; 31*a*, 31*b* first temperature sensor; 34*a*, 34*b*, 34*c*, 34*d* second temperature sensor; 35*a*, 35*b*, 35*c*, 35*d* third temperature sensor; 36 pressure sensor; 40*a*, 40*b*, 40*c*, 40*d* first backflow prevention device (check valve); 41*a*, 41*b*, 41*c*, 41*d* second backflow prevention device; 43*a*, 43*b*, 43*c*, 43*d* first backflow prevention device (second on-off device); 51, 52 on-off device (first on-off device or third on-off device); 100, 101 air-conditioning apparatus; A refrigerant circuit; B heat medium circuit.

The invention claimed is:

1. An air-conditioning apparatus, comprising:

a refrigerant circuit that is a circuit through which a heat source side refrigerant flows, the refrigerant circuit connecting a compressor, a heat source side heat exchanger, a plurality of expansion devices, a first refrigerant flow switching device, and a plurality of heat exchangers related to heat medium that exchange heat between the heat source side refrigerant and a heat medium different to the heat source side refrigerant wherein the plurality of heat exchangers related to heat medium are configured to be selectively fluidly connected to operate between in series and in parallel in the refrigerant circuit; and a heat medium circuit that is a circuit through which the heat medium is made to circulate, the heat medium circuit fluidly connecting the plurality of heat exchangers related to heat medium, a plurality of pumps, a plurality of use side heat exchangers, a plurality of first heat medium flow switching devices that allow an outlet side passage of each of the use side heat exchangers to be in fluid communication with each of the heat exchangers related to heat medium selectively, a plurality of second heat medium flow switching devices that allow an inlet side passage of each of the use side heat exchangers to be in fluid communication with each of the heat exchangers related to heat medium selectively, and a plurality of heat medium flow control devices that each control a flow rate of the heat medium flowing in the corresponding use side heat exchanger, wherein the air-conditioning apparatus is capable of performing a cooling and heating mixed operation mode, a first on-off device that opens and closes the heat medium circuit is provided to a portion of the heat medium circuit that is on an upstream side of each heat medium flow control device and on a downstream side of the corresponding second heat medium flow switching device, a backflow prevention device that is capable of restricting the heat medium from flowing from each first heat medium flow switching device to the corresponding heat medium flow control device is provided to a portion of the heat medium circuit that is on a downstream side of the heat medium flow control device and on an upstream side of the first heat medium flow switching device, a third on-off device that opens and closes the heat medium circuit is provided to a portion of the heat medium circuit that is on the upstream side of the heat medium flow control device and on the downstream side of the second heat medium flow switching device, either one of the first on-off device and the third on-off device is provided to a portion of the heat medium circuit that is on the upstream side of the corresponding use side heat exchanger, the other one of the first on-off device and the third on-off device is provided to a portion of the heat medium circuit that is on the downstream side of the corresponding use side heat exchanger and a plurality of second refrigerant flow switching devices configured for selectively fluidly connecting the plurality of heat exchangers related to heat medium between operating in series and operating in parallel in the refrigerant circuit.

2. The air-conditioning apparatus of claim 1, wherein the backflow prevention device is a check valve.

3. The air-conditioning apparatus of claim 1, wherein the backflow prevention device is a second on-off device that opens and closes the heat medium circuit.

4. The air-conditioning apparatus of claim 3, wherein the first on-off device is a manual on-off device and the second on-off device is a manual on-off device.

5. The air-conditioning apparatus of claim 4, wherein the first on-off device and the second on-off device are set to a closed state when the corresponding heat medium flow control device is being replaced.

6. The air-conditioning apparatus of claim 1, wherein the first on-off device is a manual on-off device.

7. The air-conditioning apparatus of claim 6, wherein the first on-off device is set to a closed state when the corresponding heat medium flow control device is being replaced.

* * * * *